US005537838A

United States Patent [19]

Mills et al.

[11] Patent Number: 5,537,838

[45] Date of Patent: Jul. 23, 1996

[54] BEVERAGE DISPENSER

[75] Inventors: Jeffrey P. Mills, Georgetown; Gary F. Sardynski, Medford, both of Mass.

[73] Assignee: Jet Spray Corp., Norwood, Mass.

[21] Appl. No.: 333,220

[22] Filed: Nov. 2, 1994

[51] Int. Cl.[6] ..... B67D 5/62

[52] U.S. Cl. ..... 62/400; 222/146.6

[58] Field of Search ..... 62/59, 398, 399, 62/400; 222/78, 108, 129.1, 146.6

[56] References Cited

U.S. PATENT DOCUMENTS

| | | |
|---|---|---|
| Re. 33,943 | 6/1992 | Arzberger et al. . |
| D. 109,919 | 5/1938 | McHenry . |
| D. 193,759 | 10/1962 | Hodgman . |
| D. 202,023 | 8/1965 | Gordon . |
| D. 233,271 | 10/1974 | Holcomb . |
| D. 282,617 | 2/1986 | Hogan . |
| D. 337,019 | 7/1993 | Newnan . |
| 441,628 | 11/1890 | Coon et al. . |
| 1,649,688 | 11/1927 | Harrison . |
| 1,654,379 | 12/1927 | Matzka . |
| 1,708,212 | 4/1929 | Benham . |
| 1,760,887 | 6/1930 | Saugman . |
| 1,782,943 | 11/1930 | Stanford et al. . |
| 1,782,944 | 11/1930 | Stanford et al. . |
| 1,799,852 | 4/1931 | Jones . |
| 1,807,966 | 6/1931 | Corcoran . |
| 2,072,841 | 3/1937 | Tracey et al. . |
| 2,186,564 | 1/1940 | Thiberg . |
| 2,741,400 | 4/1956 | Hazzard . |
| 3,240,395 | 3/1966 | Carver ..... 222/129.1 |
| 3,255,609 | 6/1966 | Jacobs et al. . |
| 3,323,813 | 6/1967 | Gordon . |
| 3,339,334 | 9/1967 | Gordon . |
| 3,341,077 | 9/1967 | Gordon . |
| 3,342,384 | 9/1967 | Jacobs . |
| 3,360,956 | 1/1968 | Gordon . |
| 3,385,413 | 5/1968 | Jacobs et al. . |
| 3,503,541 | 3/1970 | Jacobs et al. . |
| 3,539,081 | 11/1970 | Norton et al. . |
| 3,568,887 | 3/1971 | Jacobs et al. . |
| 3,575,536 | 4/1971 | Jacobs et al. . |
| 3,582,096 | 6/1971 | Norton et al. . |
| 3,591,055 | 7/1971 | Norton . |
| 3,710,981 | 1/1973 | Arzberger et al. . |
| 3,730,144 | 5/1973 | Arzberger . |
| 3,730,488 | 5/1973 | Gardner, Jr. . |
| 3,737,076 | 6/1973 | Gardner, Jr. et al. . |
| 3,822,565 | 7/1974 | Arzberger . |
| 3,851,127 | 11/1974 | Gardner, Jr. et al. . |
| 3,880,329 | 4/1975 | Gardner, Jr. et al. . |
| 3,903,628 | 9/1975 | Goveau . |
| 3,915,341 | 10/1975 | Brown . |
| 3,920,163 | 11/1975 | Brown . |
| 3,927,802 | 12/1975 | Lavochkin et al. . |
| 4,610,145 | 9/1986 | Arzberger et al. . |
| 4,645,095 | 2/1987 | Coppola . |
| 4,717,045 | 1/1988 | Coppola . |
| 4,728,005 | 3/1988 | Jacobs et al. . |
| 4,757,625 | 7/1988 | Watkins . |
| 5,174,239 | 12/1992 | Sato . |
| 5,402,914 | 4/1995 | Zapp . |

FOREIGN PATENT DOCUMENTS

| | | |
|---|---|---|
| 1244907 | 11/1988 | Canada . |

OTHER PUBLICATIONS

Tower Max™ Simulated Bubbler Owners Manual, no date available.

*Primary Examiner*—William E. Tapolcai
*Attorney, Agent, or Firm*—Wolf, Greenfield & Sacks

[57] ABSTRACT

A dispenser combines the efficiency of a post-mix dispenser, while providing the visual appeal of a visual spraying dispenser. A bowl holds a liquid that is circulated through a cooling system to provide a cool spray, and thus to create condensation on the outside of the bowl. The beverage that is dispensed is from remote supplies of concentrated syrup and water. The bowl has a single body that defines a number of compartments. The body is covered with a lid, and rests on a concentrate tray that drains away condensate that build up on the body. The body is easily removably and replaceably coupled to the tray. The valves for dispensing are on a movable support so that the height of the dispenser can be made smaller while still providing manual access to the valves.

19 Claims, 8 Drawing Sheets

BEVERAGE DISPENSER

FIELD OF THE INVENTION

This-invention relates to beverage dispensers, and particularly to post-mix beverage dispensers.

BACKGROUND OF THE INVENTION

Jet spray corporation, located in Norwood, Mass., has for many years been making "visuals", i.e., beverage dispensers that spray a beverage in a clear bowl. In U.S. Pat. No. 3,822,565, for example, a beverage dispenser has a clear bowl in which an evaporator is disposed for cooling the beverage. A spray tube is positioned over the evaporator. A pump directs the cooled beverage through the spray tube against the underside of a cover. The beverage in the bowl is dispensed through a discharge spout by actuating a handle. Many visuals have now been replaced by post-mix dispensers, such as a dispenser as described in Reissue No. 33,943. These dispensers, which reconstitute syrup with fresh water, are efficient and convenient because more drinks can be drawn without having to refill a bowl.

SUMMARY OF THE INVENTION

According to the present invention, a beverage dispenser provides a cool drink, while it separately circulates liquid from a clear, transparent bowl to a cooling system and then through a spray tube within the bowl to provide a cool, visually appealing spray. The dispenser is preferably a post-mix dispenser in which the drink that is dispensed is made from reconstituted syrup and potable water, each of which are received from a remote supply and combined in a dispenser valve.

The bowl has an integral body that has a floor, sides, dividers, and an open top. The body defines a number of mutually, fluidly insulated compartments. Each compartment is fluidly coupled to a respective pump that directs the liquid from the compartment through a cooling system and back into a spray tube in the bowl. The liquid is sprayed close to an underside of a lid and cascades downward in the bowl to provide an attractive appearance. The pumps can also empty the compartments for cleaning. The liquid that is cooled in the cooling system, preferably to a temperature less than about 8° C. (45° F.), cools the sides of the body, thus causing the sides to sweat with condensation.

The body has a floor with one inlet and one outlet per compartment, the inlet being fluidly coupled to the spray tube and the outlet being fluidly coupled to the pump. A two-piece lid covers the open top of the body. The two pieces of the lid are formed and bonded to define a sealed, insulating air space over each compartment. Because of the air space, the top of the lid does not sweat.

The body rests on a condensate tray that has integral standoffs. The standoffs cause a space to be formed between the floor of the body and the floor of the condensate tray. The tray floor slopes to a generally centrally positioned drain. The condensation rolls down the sides of the body and onto the tray where it is drained.

The cooling system preferably includes an ice bath that has a container for holding cold bath water. This water is kept cold by an evaporator coil that carries a refrigerant. The coil is wound in the bath water. The cooling system also cools fresh, potable water in a water coil fluidly coupled to a water supply; syrup in a syrup coil fluidly coupled to a syrup supply; and liquid in liquid coils fluidly coupled to each compartment. The water coil and liquid coils are in the bath water, while the syrup coil is preferably held in direct contact with the exterior of the ice bath container. The syrup supply and the water supply are preferably remote from the machine; for example, the concentrate can be in a large container in a separate room or behind a counter, and the water supply may be a municipal water system. The water coil is positioned around the liquid coils closely so that it does not move toward the evaporator coil when in operation.

The syrup and water are combined in adjustable, presettable proportions in a dispenser valve from which reconstituted juice, such as orange juice, fruit punch, or lemonade, is dispensed. Some commercially available dispenser valves have dials that require access at the top and rear of the dispenser valves to disconnect them for service and maintenance. The valves are mounted on a plate that is pivotally coupled to a frame of the dispenser to 25° of movement downward. Thus, during normal operation, the plate is in a first position in which it is oriented horizontally so that the valves are positioned just beneath the condensate tray and so that the controls are manually inaccessible. For maintenance, the plate is moved to a second position so that these controls are easily manually accessible. This arrangement allows the dispenser to be reduced in height compared to prior dispensers.

The present invention has the convenience and efficiency of a post-mix dispenser, while it also has the appeal of a visual spraying dispenser. The dispenser has a number of other advantages. Since the spray is cool, condensation forms on the side of the bowl and thus attractively markets the juice, while the two-piece lid prevents condensation from forming on top of the lid. The parts of the bowl, lid, and spray tubes are designed so that they are easy to assemble, disassemble, clean, and replace. The bowl can be removed from the tray with no significant effect on the pumps, valves, or conduits coupled to the tray. Because the bowl has a single, integral, compartment-defining body, different liquids can be stored in the bowl without requiring separate containers. The syrup is cooled before being combined with the potable water, so the drinks that are provided are cool even when many drinks are drawn in a short period of time. The liquid coils in the ice bath locate the water coil, and thus spacers for holding the water coil away from the evaporator coil are unnecessary. Because the valves are mounted on a movable support, it is not necessary to provide a substantial amount of access space above the valves. Rather, the valves can be positioned just under the containers, thus decreasing the vertical height of the dispenser.

The liquid in the bowl can be the same type as the liquid that is dispensed, and thus the bowl can easily be filled by drawing the drink from the valve and pouring it into the bowl. Because the liquid in the bowl is kept cool, the drink can be used in the bowl for an extended period of time. If the drink were used in the bowl but not kept cool, it could deteriorate quickly. The liquid could alternatively be a colored liquid that simulates a drink that is dispensed. While it is preferred that a post-mix valve be used, the drink could be pre-mixed, stored in a remote location, and provided to a simple valve, such as a discharge spout, for dispensing. Regardless of what liquid is provided in the bowl, the system fox circulating the liquid to the ice bath and the dispensing system for providing a cool drink are fluidly insulated. This means that the drink that is dispensed and the liquid in the bowl are not combined or otherwise mixed.

BRIEF DESCRIPTION OF THE DRAWINGS

Other features and advantages will become apparent from the following detailed description and from the drawings in which.

DETAILED DESCRIPTION

Figure 1:
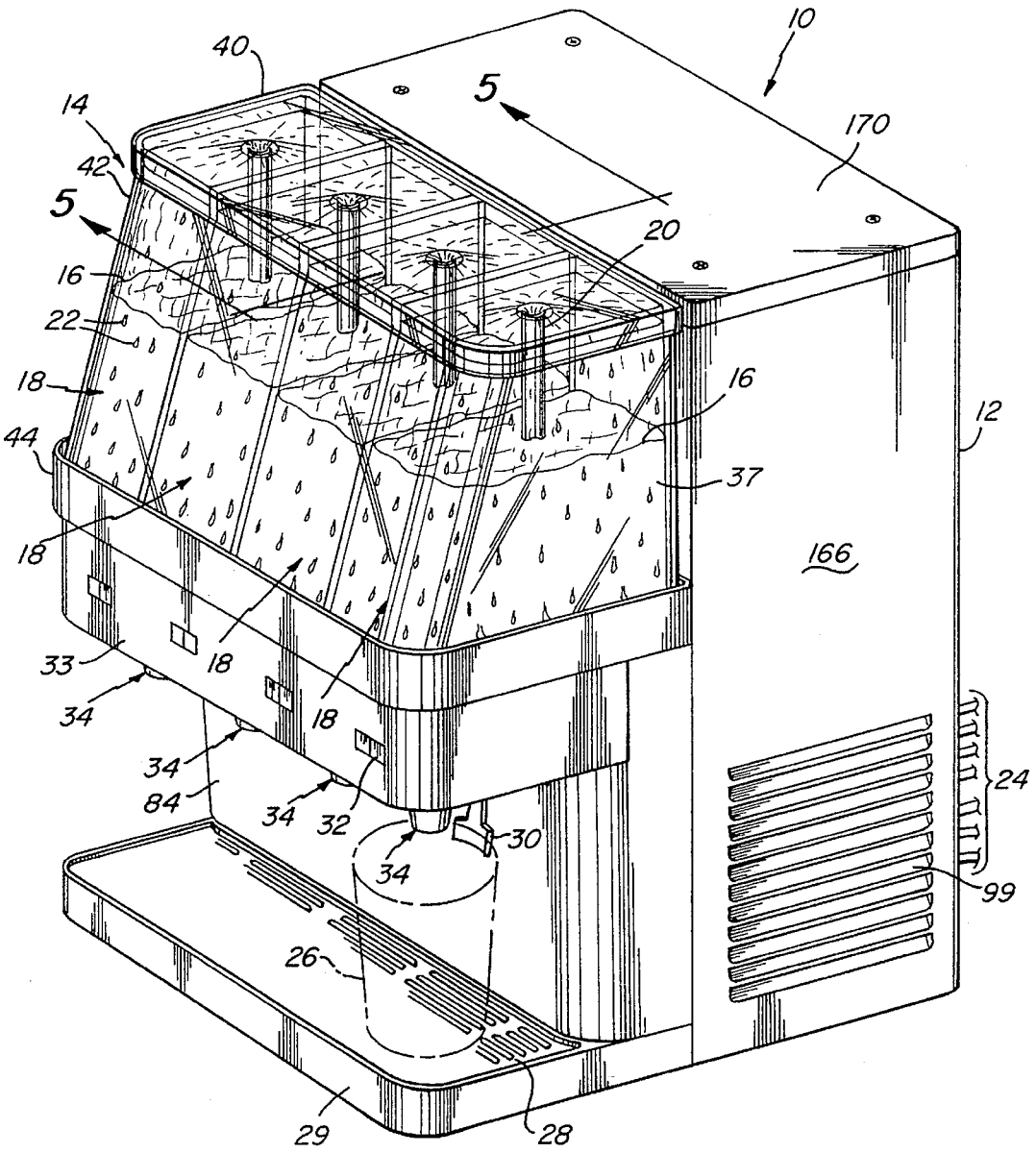
FIG. 1 is a perspective view of a beverage dispenser according to the present invention.

Referring to FIG. 1, a post-mix beverage dispenser 10 has a housing 12 onto which a transparent bowl 14 is mounted. The bowl holds liquid 16 in each of four separately sealed compartments 18. Within each compartment, a straight, plastic spray tube 20 extends vertically to direct a spray of the liquid against an underside surface of a lid 40, thus causing the liquid to cascade downward in the bowl. Liquid 16 is cooled to a sufficiently low temperature, preferably less than about 8° C. (45° F.), so that the bowl sweats, thus forming drops 22 of condensation that run down the sides of the bowl. The liquid should be sufficiently low in temperature to cool the body so that condensation forms under most normal temperature and humidity conditions in which the dispenser would be used. One type of liquid can be used in each of the compartments, or up to four different types of liquid can be provided in respective compartments.

The liquid in the compartments is not actually dispensed for drinking; rather, the drink is made by reconstituting a concentrated syrup and water that are provided from external sources via conduits 24. These conduits include four syrup lines, a potable water line, an AC power line, and a drain conduit. The syrup may be held in a bag-in-box container in a remote location, while the water may be from a municipal water supply.

The syrup and water conduits are fluidly coupled to four dispensing valves 34, each of which combines the water and syrup in adjustable, pre-settable proportions and provides a cold drink. To draw the drink, a cup 26 is positioned over a grille 28 that is on a drip tray 29. Some valves have a push handle switch 30 against which the user can push the cup to activate the switch by physical contact. If a valve is used that does not have such a switch, one or more buttons 32 can be provided to cause the dispenser to dispense the drink. Buttons 32, which are mounted on a bezel portion 33, are coupled to circuitry that is incorporated in the valve. The buttons can include a "stop-and-hold" switch, which dispenses the drink for as long as the button is held, or, additionally or alternatively, can include buttons that provide measured portions. These measured portions can be preset by adjusting controls in system circuitry (not shown) or by using a learning mode in which the circuitry causes a drink to be dispensed for as long as a user causes the dispenser to dispense during a test run. Such a learning mode and an ability to set proportions in circuitry are provided, for example, in a model OJ 2000, a different type of post-mix dispenser that is available from Jet Spray Corp. (a type that has a refrigerated compartment for holding one or more containers of syrup within the housing, as in Reissue 33,943).

Figure 2:
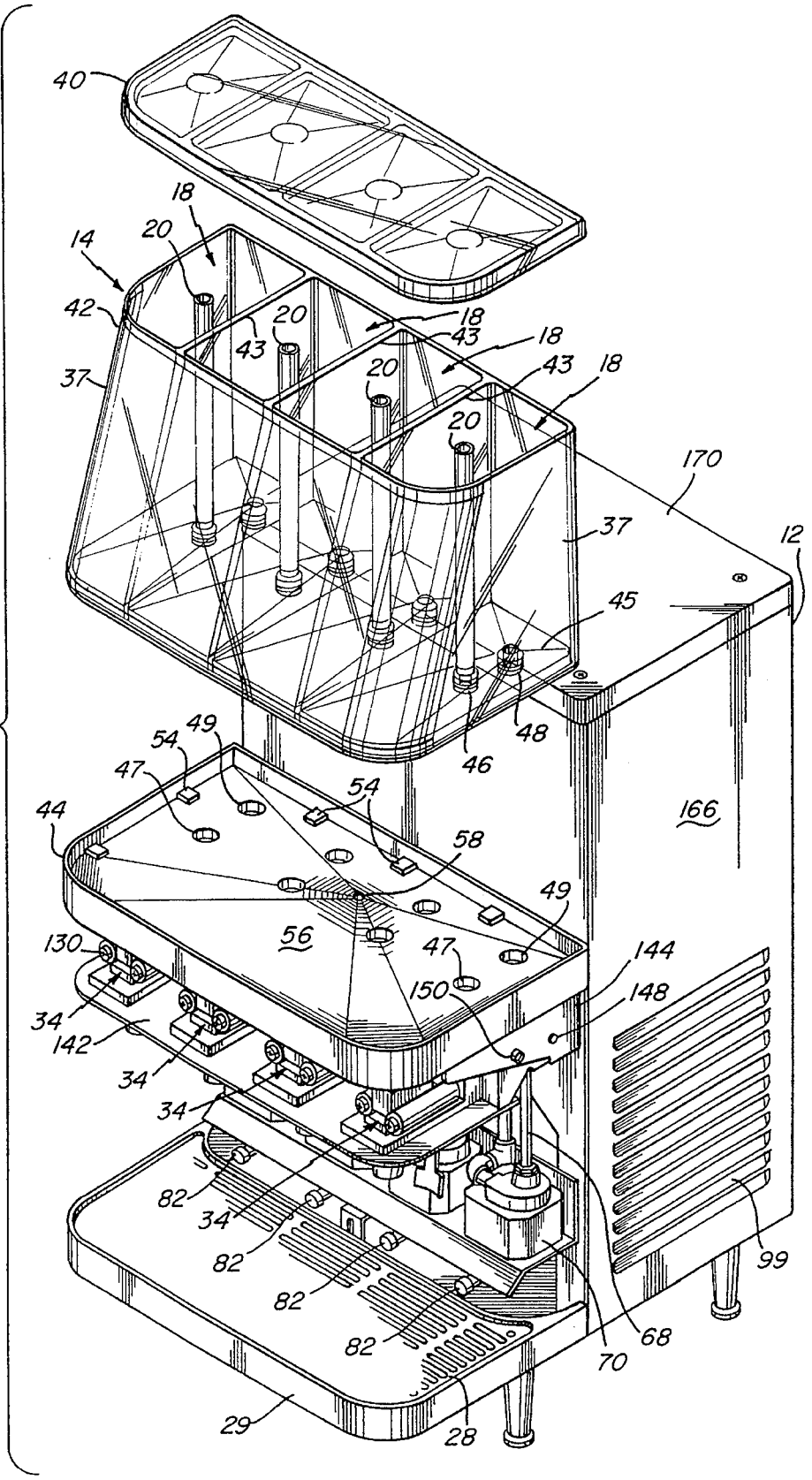
FIG. 2 is an exploded perspective view of the dispenser of FIG. 1.
Figure 3:
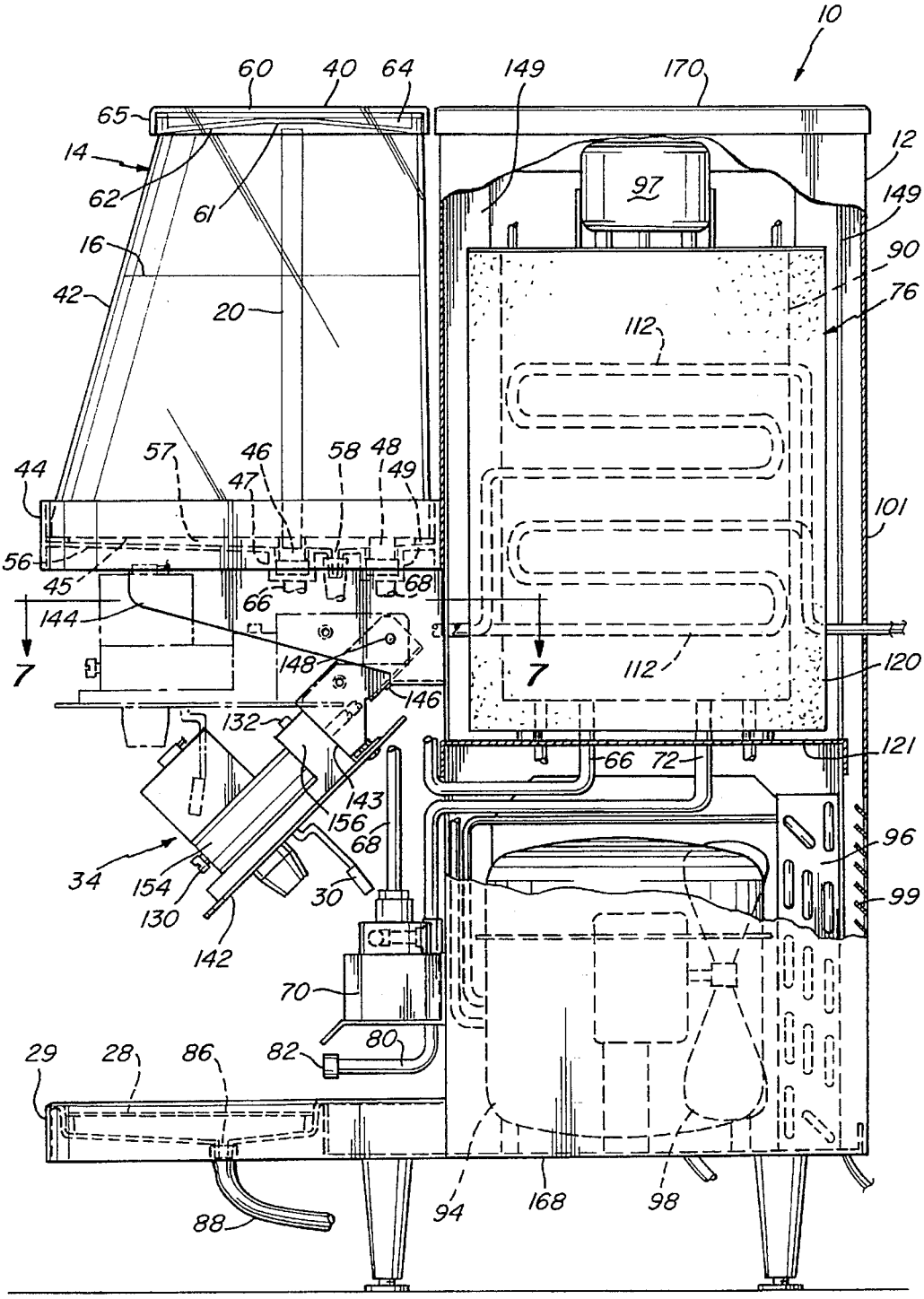
FIG. 3 is a side elevational view with portions removed and other portions in dashed line.

Referring also to FIGS. 2–6 and particularly to FIG. 2, bowl 14 has an integral compartment-defining body 42, which has a gently sloping floor 45, side walls 37, three dividers 43 that define four compartments, and an open top. The body has openings with integral downward extensions 46, 48 that define a front inlet and a rear outlet, respectively, for each compartment 18. Each front inlet is fluidly coupled to a respective spray tube 20. The rear outlets are at a lowest part of the floor in each compartment for providing drainage to a respective pump 70.

Figure 4:
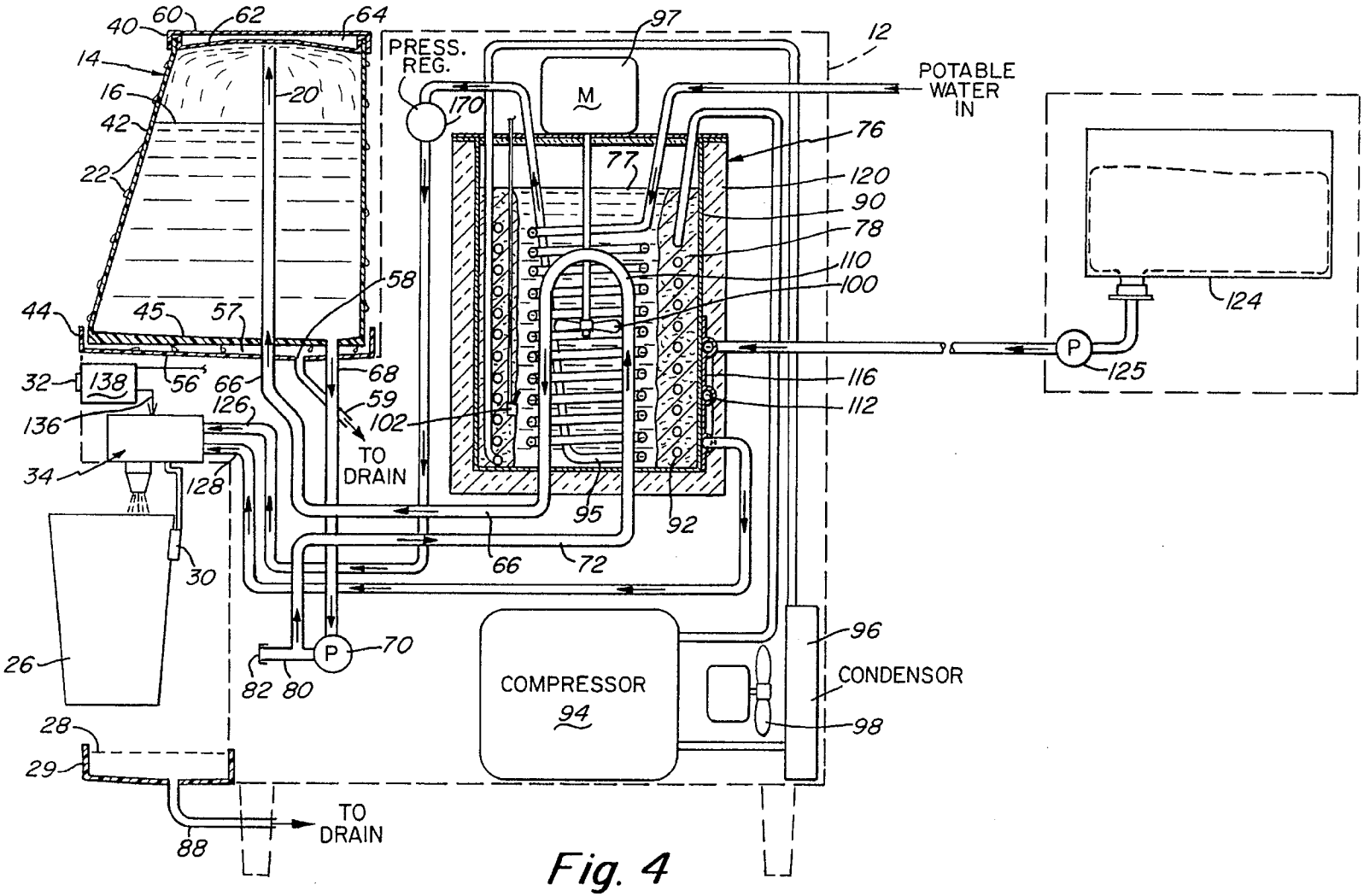
FIG. 4 is a partial schematic, partial cross-sectional view of the dispenser.
Figure 5:
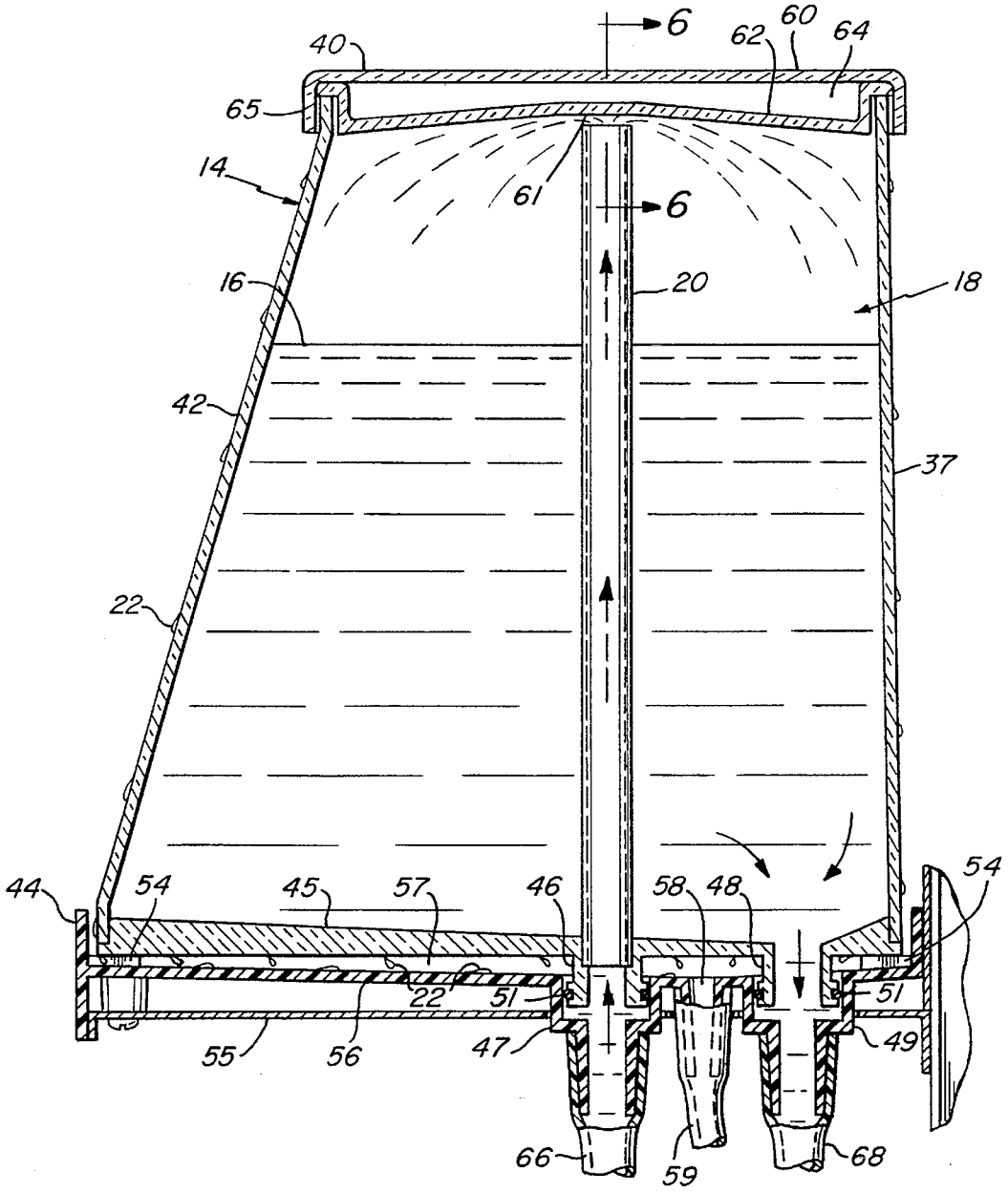
FIGS. 5–8 are cross-sectional views taken along section lines 5—5 of FIG. 1; 6—6 of FIG. 5; 7—7 of FIG. 3; and 8—8 of FIG. 7, respectively.

The body rests on a condensate tray 44 that is rigidly connected to a shelf 55 (FIG. 5). Condensate tray 44 has a sloping floor 56 on which standoffs 54 are distributed so that when the body is on the tray, a space 57 is defined between them. At the lowest point of the floor is a drain 58. As shown in FIGS. 4 and 5, in operation, the bowl sweats and the condensation rolls down the side of the body. Because of the space provided by spacers 54, the condensation collects on the floor of the tray and eventually is drained through drain 58 that is fluidly coupled to a drain conduit 59.

Referring in particular to FIG. 5, the underside of the condensate tray has integral extensions 47, 49 for fluidly coupling conduits 66, 68 to respective extensions 46, 48. Extensions 46, 47 and 48, 49 are sealed with O-rings 51 that are disposed in annular grooves in extensions 46, 48.

Figure 6:
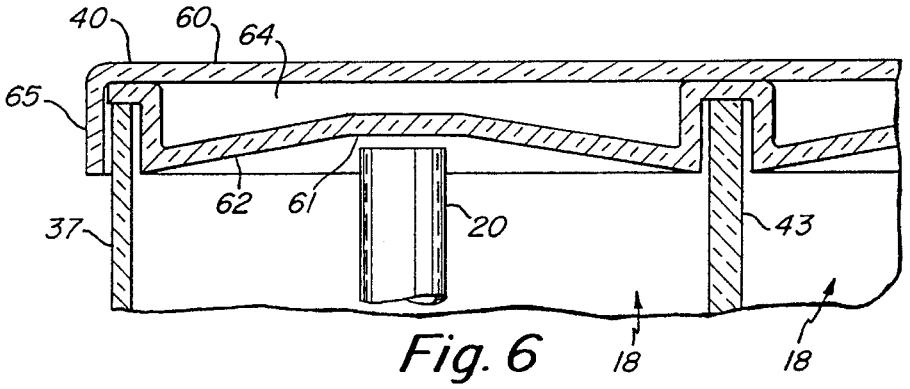

Referring also to FIG. 6, a two-piece lid 40 that covers the open top of the body has a top piece 60 bonded to a bottom piece 62. The top piece has a generally flat top with a downwardly directed flange 65 that extends around the periphery of the flat top. The bottom piece is formed to define a sealed air space 64 over each compartment 18, while the top and bottom pieces meet and are bonded together at portions over dividers 43. The insulating air space prevents condensation from forming on the top of top piece 60. The spray tube extends within about ⅛ inch of a bottom concave portion 61 of bottom piece 62. The lid rests on the body, preferably without any additional coupling means and without a gasket or other seal member.

The lid, body, and spray tubes are all designed to fit together and to sufficiently seal while also being easy to disassemble and remove for maintenance and cleaning. Because of the mating extensions and the O-ring seals, the body can be easily separated from the tray by simply lifting it from the tray. Thus, the body can be easily removed and replaced for maintenance, replacement, or cleaning without removing, disturbing, or disconnecting the pumps, the valves, and conduits 66, 68 that are coupled to the tray.

Referring in particular to the schematic representation of FIG. 4, each liquid 16 is fluidly coupled through a conduit 68 to a representative pump 70. The pump circulates the liquid from compartment 18 through conduit 68 and 72 and into a cooling system 76. The liquid, having been cooled in the cooling system, is fluidly coupled to spray tube 20 via conduit 66. The cooling system is remote from the bowl in that it is physically spaced from the bowl rather than extending into the bowl. The pump is also fluidly coupled to a short conduit 80 through which the liquid in the compartment can be pumped out. To drain the liquid from the compartment, a user removes a cap 82 that covers an end of conduit 80. The short conduit direct the liquid into a suitable container or into the drip tray.

While the liquid in the bowl is circulated to the cooling system, it is not fluidly coupled to dispenser valves 34, and thus the liquid is fluidly insulated or fluidly separated from the valves. This means that the liquid in the bowl and the drink that is dispensed are not the same and are not mixed.

Figure 9:
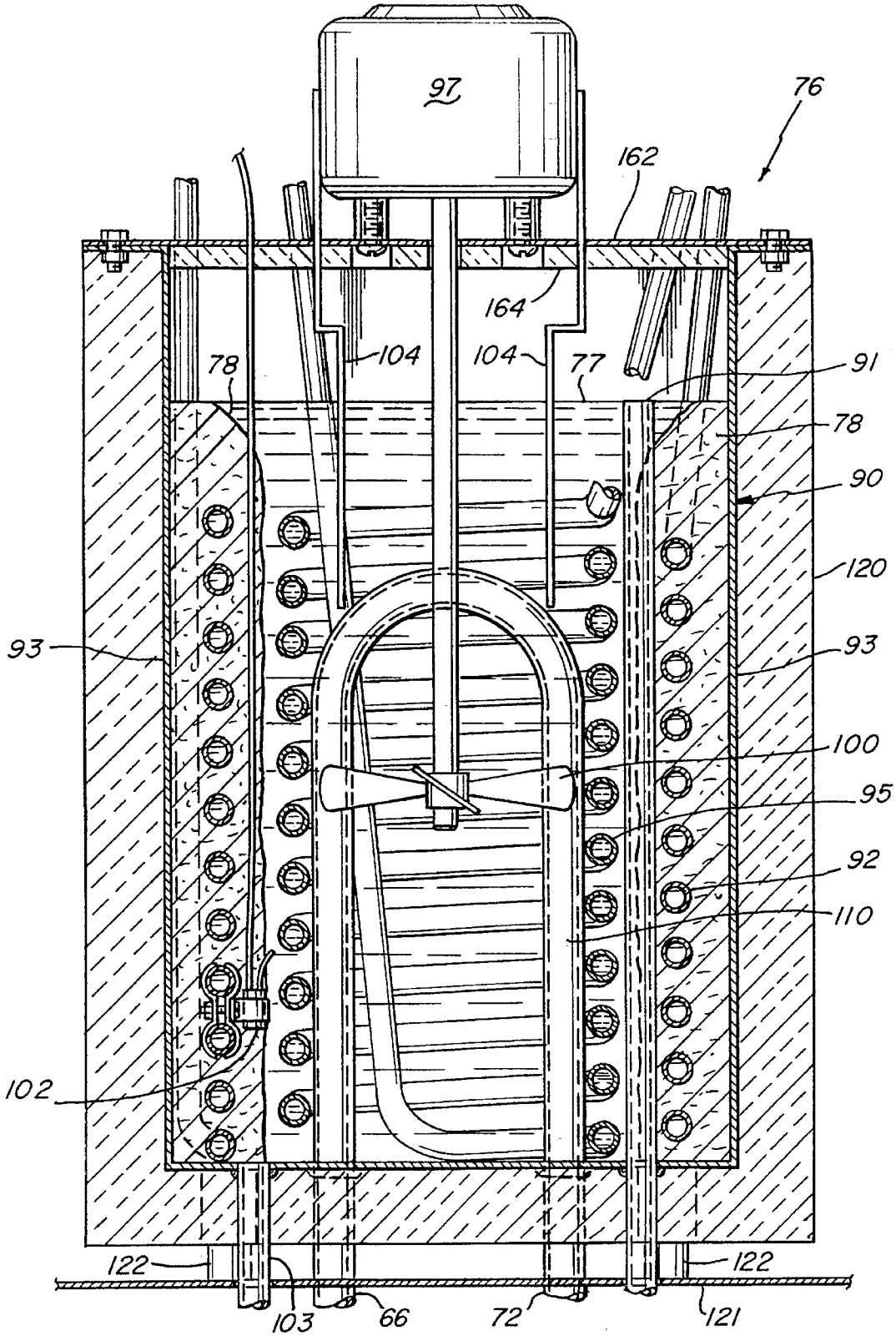
FIG. 9 is a cross-sectional view of an ice bath.

Referring to FIGS. 3, 4, 9, and 10, and particularly to FIG. 9, cooling system 76 cools the liquids in the bowl, the potable water, and the syrup. System 76 includes an ice bath assembly that has a box-shaped container 90. The container is filled to a desired level with cold bath water 77. To prevent overfilling, an overfill conduit 91 extends vertically through a floor of the container to the desired level.

Disposed in the bath water is an evaporator coil 92 that winds around the inner periphery of the walls 93 of the container. Referring also to FIG. 4, coil 92 carries a refrigerant, such as R134a, that is fluidly coupled to, and circulated by, a compressor 94 and a condenser 96. A fan 98 (FIGS. 3 and 4) blows warm air through louvers 99 that can be located in either side walls 166 or in a rear wall 101 of the housing.

When circulated, the refrigerant in the evaporator coil causes the coil to be substantially below 0° C., thus causing ice 78 to build up on, and completely surround, the coil. The ice thus causes the bath water in the container to be kept very close to 0° C., typically about 0.1°–0.3° C. A drain conduit 103 that is typically capped extends away from the floor of the container and is used when the container is emptied for cleaning or maintenance. A sensor 102 (FIG. 9) is mounted in the container near coil 92 to sense a level of ice build-up by detecting water through capillary action. The sensor is electrically coupled to the compressor for causing the compressor to be activated and deactivated in response to the level of ice build-up. The compressor can cause up to about fifteen pounds of ice to form on the evaporator coil. This ice creates a reserve cooling capacity that keeps the compressor from being run continuously.

To maintain the bath water at an even and consistent temperature within the container, an agitator motor 97 continuously drives an impeller 100 that creates turbulence in the water. The turbulence also improves heat transfer between potable water in a water coil and the bath water. Copper heat sinks 104 are mounted on the exterior surface of motor 98 and extend from the motor into the bath water.

Figure 10:
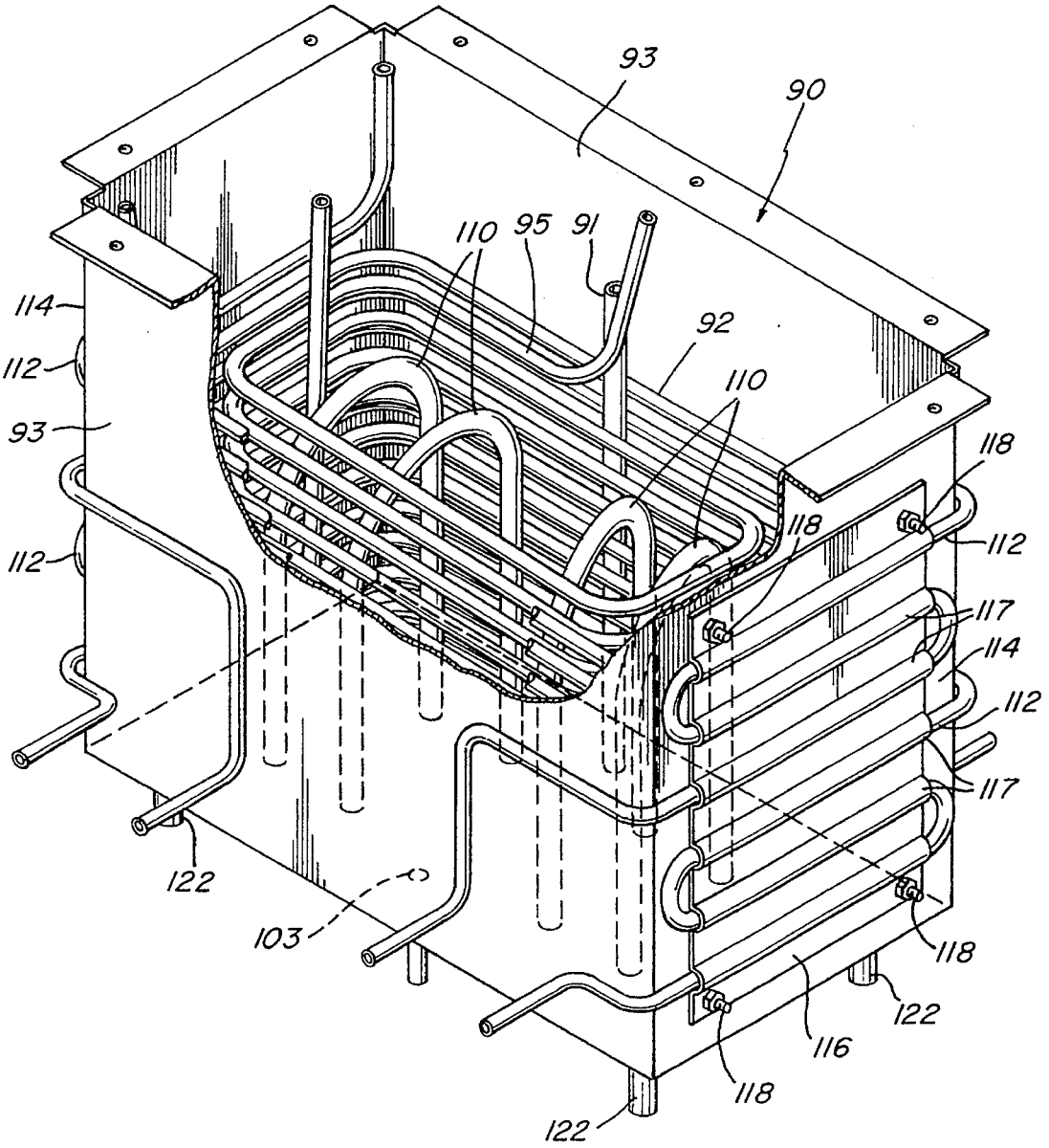
FIG. 10 is a partially broken away perspective view of an ice bath container and coils.

Referring to FIGS. 9 and 10, four inverted U-shaped coils 110 are welded to a floor of the ice bath container 90 and are fluidly coupled to a respective pump 70 and a respective compartment 18 through conduits 66, 72. Two of the coils are positioned on either side of the impeller. The coils position and hold in place a water coil 95 that is pressed over coils 110 so that there is a close fit. This positioning is important because the water coil must be sufficiently spaced from the evaporator coil, which is coaxially disposed around the water coil, so that the potable water in the water coil does not freeze. The U-shaped coils thus prevent the water coil from shifting after the water coil is positioned.

Referring in particular to FIG. 10, two syrup coils 112 are mounted against the exterior walls of each of two sides 114 of container 90. These coils are coupled to the exterior so that the design of the interior of the ice bath is not further complicated. The syrup coils are connected against the sides with copper plates 116 that have channels 117 though which straight portions of the syrup coils extend. The heat sinking plates are held to the sides with threaded studs 118 that are welded to the sides. Around the exterior of the sides and the bottom of the container is a one-inch thick layer of foam insulation 120 (FIG. 9). On top of the container is a cover 162 that has 0.25 inches of foam insulation 164 on its underside. Ice bath container is supported on shelf 121 with standoffs 122.

Referring also to FIG. 4, the syrup and potable water that are cooled by the ice bath assembly are provided to dispenser valves 34 for dispensing. The syrup may be provided from a bag-in-box container 124 that is kept at a remote location, e.g., behind a counter or in a storage room. Pump 125 pumps syrup from container 124, to coils 112, conduit 128, and into valve 34. The potable water received by coil 95 has a pressure that is regulated with a pressure regulator 170. The water is then fluidly coupled to valve 34 through a conduit 126 to a splitting assembly (not shown) and then to each valve 34.

Figure 7:
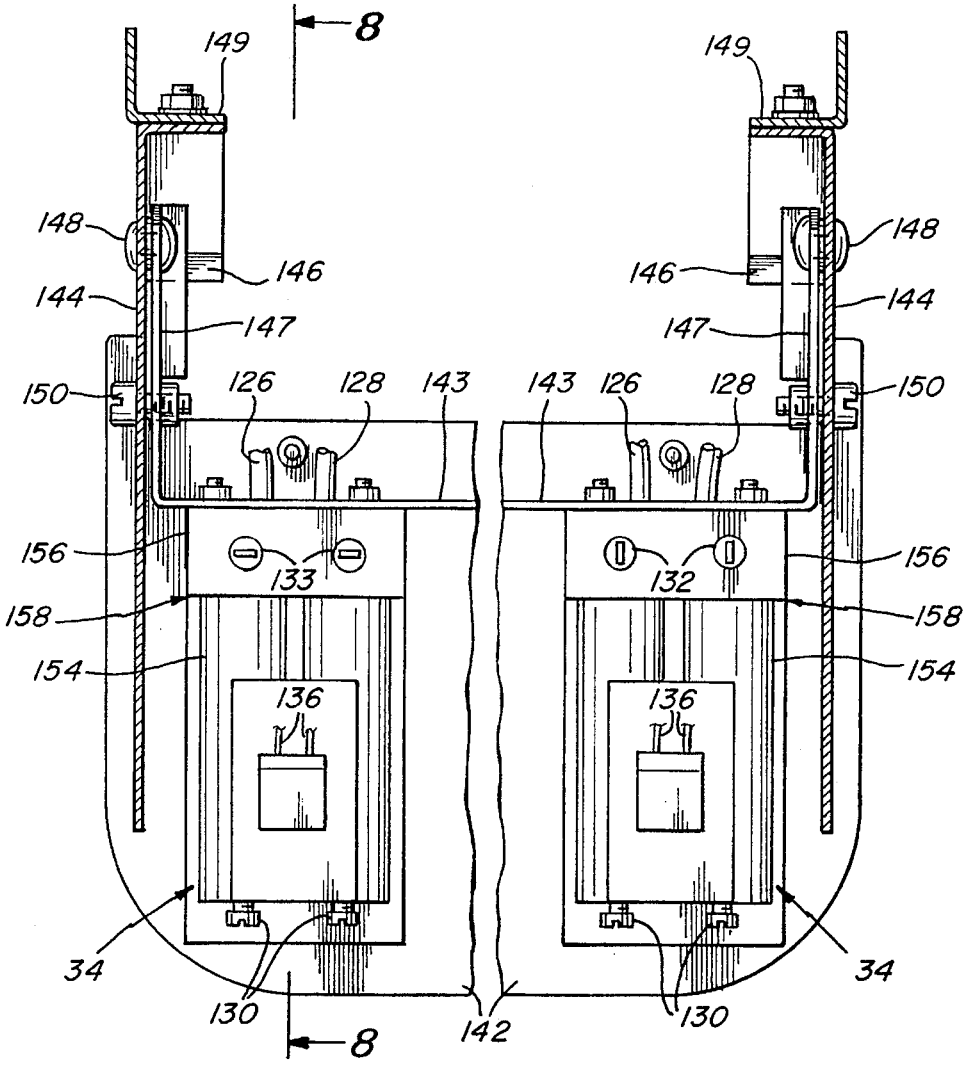
Figure 8:
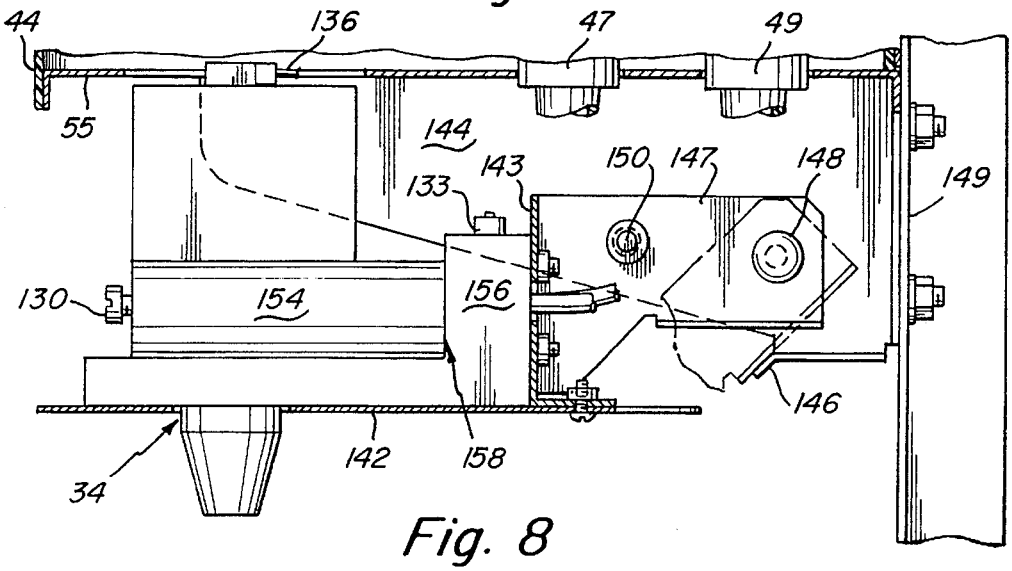

Referring to FIGS. 3, 4, 7, and 8 in general and particularly to FIGS. 7 and 8, the water and syrup are provided to valves 34 through conduits 126, 128. The valves have electrical lines 136 for connecting to electrical circuitry 138 (FIG. 4). Circuitry 138 is coupled to buttons 32 (FIG. 1) for controlling dispensing. Adjustable control screws 130 are on a front face of the valve. With these screws, a user can adjust the proportions of water and syrup.

On top of the valve and at the rear are dials 132, 133 for adjusting ball valves (not shown) that control the coupling between valves 34 and conduits 126, 128. Dials 132 are set so that the handles point in the direction of flow, meaning that the ball valves are open; dials 133 have handles that are 90° from the handles of dials 132, indicating that the ball valves are closed. To remove valves 34 for service or replacement, the ball valves are closed as indicated by dials 133, a bail (not shown) is raised, and a front part 154 of the valve is removed from a rear part 156 at a break line 158. The front part has the circuitry, which is most likely to require maintenance. Because of the need for access to dials 132, 133 to disconnect conduits 126, 128, typical dispensers provide a significant space above the valves for replacement and service.

According to the present invention, the valves are rigidly mounted to a bracket 143 that has an L-shaped cross-section behind the valves. Behind the valves, the bracket has a portion that is in a plane parallel to rear wall 101 of the housing. At the sides of the dispenser, the bracket curves to two portions 147 that are in planes parallel to side walls 166 (FIG. 1) of the housing. Portion 147 are pivotally connected to vertical support members 144 through pivots 148. The support members have an L-shaped bend and are screwed to stationary vertical frame members 149. Plate 142 and bracket 143 are rotatable downward by 25° until they contact stops 146. These stops are projections of support members 144, and may, if desired, have end portions that slant downward by 25°.

The bracket is normally held in a first operating position with release screws 150 that extend through support members 144 and engage threaded nuts attached to portions 147 of the bracket. When the screws are removed, the bracket 143 and plate 142 can be lowered. Thus, in a first operating position (in phantom line in FIG. 3), the valves partially extend through shelf 55 (FIG. 8) to a position very close to tray 44. In a second servicing position (in solid line in FIG. 3), the bracket pivots downward about 25° and rests on the stops to provide sufficient space to allow easy access to dials 132, 133 for maintenance and replacement (note that the pivoting angle is exaggerated in the figures).

The housing includes internal frame components, including shelf 121, shelf 55, and vertical frame members 149, that provides structural support and are constructed of 14 gauge galvanized steel. These frame components are assembled with ¼ inch diameter rivets and bolts and are designed to eliminate shear forces on the rivets. The drip tray grille 28, side walls 166, bottom wall 168, rear wall 101, bezel portion 33, and a lower front wrapper 84 (FIG. 1) of the housing are preferably made of stainless steel.

Body 42 and lid 40 are preferably made from clear polycarbonate. The body is preferably completely clear and transparent, although it could be partially transparent. The body is preferably made from two molded pieces, one of which has side walls 37 and dividers 43, and a second of which has the floor with extensions 46, 48. These pieces are rigidly and tightly bonded together to be essentially an integral piece. The drip tray 29, lid 170, and condensate tray 44 are molded from black polycarbonate.

The evaporator coil is preferably a 0.375 (OD) copper conduit, while U-shaped coils 110, potable water coil 95, and syrup coils 112 are preferably stainless steel.

Sensor 102 is available from Ranco North America, located in Dublin, Ohio. Alternatively, the sensor could extend downward into the container for physically detecting ice build-up. The valve is preferably a model PRV1, available from Wilshire Corporation, Torrington, Conn. Other valves can also be used, including, for example, a valve made by Lancer for use with Coca-Cola® products. The pumps are preferably G-100 A5 models, available from Beckett Corporation, Dallas, Tex. The ice bath container is preferably made of stainless steel, and measures about 7.5×14.75×12 inches in dimension.

Having described a preferred embodiment of the present invention, it should become apparent that other alterations and modifications can be made without departing from the scope of the impending claims. Other embodiments are within the scope of the following claims. For example, while the present assembly has been described as having three dividers and four separate compartments, the number of compartments can be varied. Of course, a user can provide one type of juice in more than one compartment. Since the liquid in the bowl is not dispensed, it could be the same as the dispensed drink, and thus the container can be filled with liquid drawn from the dispensing valves. Alternatively, a liquid, such as colored water, that simulates a drink that is dispensed can be provided in the compartments. The syrup coils could extend into the ice bath assembly. If the spraying feature were omitted, coils similar to the U-shaped coils could be used as syrup coils. While the coils have been shown as having a particular shape, such as having an S-shape, U-shape, or helical winding, these coils can take on any shape that accomplishes the desired function. The coils and the conduits can refer to a single member or multiple members coupled together, such as coils 110 and conduits 66 and 72, or also multiple members with intervening components, such as pumps, valves, and regulators.

What is claimed is:

1. A post-mix beverage dispenser for dispensing a drink made by reconstituting syrup with potable water, the dispenser comprising:

a housing;

a bowl, mounted to the housing, for holding liquid;

a valve, mounted in the housing, for combining syrup and potable water for dispensing;

an ice bath mounted in the housing and having a container for holding cold bath liquid;

a potable water conduit fluidly coupled to the valve;

a syrup conduit fluidly coupled to the valve;

a liquid conduit fluidly coupled to the bowl and extending to the ice bath; and a pump fluidly coupled to the bowl and to the liquid conduit for circulating the liquid in the bowl through the liquid conduit in the ice bath; 'wherein the bowl, the liquid conduit, and the pump are fluidly isolated from the valve, the potable water conduit, and the syrup conduit.

2. The dispenser of claim 1, wherein the syrup conduit is coupled to an exterior wall of the ice bath for cooling the syrup.

3. The dispenser of claim 1, wherein the bowl includes an integral body having a floor, side walls, and at least one divider for defining n compartments that are fluidly insulated from each other, n being an integer greater than 1.

4. The dispenser of claim 3, including a total of n pumps, n dispenser valves, n syrup conduits, and n liquid conduits.

5. The dispenser of claim 1, wherein the ice bath has a container for holding cold bath water, the dispenser further comprising a refrigerant conduit, a compressor, and a condenser, the compressor and condenser for circulating refrigerant in the refrigerant conduit, the refrigerant conduit being disposed in the container.

6. The dispenser of claim 5, wherein the potable water conduit and the liquid conduit are disposed in the container.

7. A beverage dispenser comprising:

a housing;

a valve mounted in the housing for providing a beverage for drinking;

a bowl mounted to the housing for holding a liquid;

a spraying mechanism mounted in the bowl; and a cooling system mounted in the housing remote from the bowl; and a circulation system fluidly coupling the bowl, the cooling system, and the spraying mechanism, so that cooled liquid is sprayed in the container, the circulation system being fluidly isolated from the valve.

8. The dispenser of claim 7, wherein the cooling system includes an ice bath having a container for holding a cold liquid, and wherein the circulation system includes a liquid conduit fluidly coupled to the container and disposed in the ice bath.

9. The dispenser of claim 8, wherein the liquid conduit is rigidly connected to the container.

10. The dispenser of claim 7, wherein the dispenser is a post-mix dispenser having a syrup conduit for coupling to a syrup supply, a potable water conduit for coupling to a potable water supply, and a valve fluidly coupled to the potable water conduit and to the syrup conduit for combining the potable water and syrup.

11. The dispenser of claim 10, wherein the syrup conduit is disposed in the cooling system so that the syrup is cooled before being combined in the valve.

12. The dispenser of claim 11, wherein the cooling system includes an ice bath having a container for holding a cold liquid, wherein the syrup conduit is rigidly held to the outside of an exterior wall of the container to cool the syrup.

13. The dispenser of claim 10, wherein the valve is coupled to a support that is movably mounted to the housing.

14. The dispenser of claim 8, further including a potable water coil for holding potable water and being fluidly coupled to the valve, the potable water coil extending around the liquid coil.

15. The dispenser of claim 14, further including a horizontally disposed tray disposed to the housing, the body being disposed on the tray, the floor of the container and the tray each having openings that are fluidly coupled and sealed when the body is on the tray.

16. A post-mix beverage dispenser for combining a syrup from a remote syrup supply and potable water from a remote water supply, the dispenser comprising:

a housing having a transparent bowl mounted thereon that holds a display fluid;

a syrup conduit and a water conduit mounted in the housing for receiving the syrup and potable water from respective syrup and water supplies; and a cooling system mounted in the housing, the syrup and water conduits extending into the cooling system for providing cooled syrup and potable water;

a display fluid conduit extending from the bowl to the cooling system that cools the display fluid, said display fluid circuit being fluidly isolated from the syrup conduit and the water conduit.

17. The dispenser of claim 16, wherein the cooling system includes an ice bath having a container for holding a cold liquid.

18. The dispenser of claim 17, wherein the syrup conduit is held against an exterior wall of the container.

19. The dispenser of claim 18, further comprising a plate rigidly mounted to the exterior wall of the container, the plate having a channel in which the conduit is disposed so that the conduit is intermediate the plate and the exterior wall.

* * * * *